US005487345A

United States Patent [19]

Winebarger et al.

[11] Patent Number: 5,487,345

[45] **Date of Patent: * Jan. 30, 1996**

[54] PARAMETRICALLY WRAPPED PALLET MEMBER AND PALLET CONSTRUCTED THEREOF

[75] Inventors: Ken N. Winebarger, Lakeland, Fla.; Stanley M. Lee, Tomball, Tex.

[73] Assignee: Unipal International Corporation, Lakeland, Fla.

[ * ] Notice: The portion of the term of this patent subsequent to Dec. 25, 2007, has been disclaimed.

[21] Appl. No.: 256,223

[22] PCT Filed: Apr. 22, 1994

[86] PCT No.: PCT/US94/04450

§ 371 Date: Jul. 5, 1994

§ 102(e) Date: Jul. 5, 1994

Related U.S. Application Data

[63] Continuation-in-part of Ser. No. 40,338, Mar. 30, 1993, Pat. No. 5,357,875, which is a continuation of Ser. No. 792,182, Nov. 14, 1991, Pat. No. 5,218,913, which is a continuation-in-part of Ser. No. 631,714, Dec. 21, 1990, abandoned, which is a continuation of Ser. No. 321,022, Mar. 9, 1989, Pat. No. 4,979,446.

[51] Int. Cl.[6] ..... B65D 19/00

[52] U.S. Cl. ..... 108/51.3; 108/56.1

[58] Field of Search ..... 108/51.3, 51.1, 108/56.1, 56.3

[56] References Cited

U.S. PATENT DOCUMENTS

| | | | |
|---|---|---|---|
| 2,287,740 | 6/1942 | Klouman . | |
| 2,446,914 | 8/1948 | Fallert et al. . | |
| 2,494,730 | 1/1950 | Thursby . | |
| 2,709,559 | 5/1955 | Geisler . | |
| 2,728,545 | 12/1955 | Hermitage . | |
| 2,925,947 | 2/1960 | Brown . | |
| 3,026,078 | 3/1962 | Simkins . | |
| 3,131,656 | 5/1964 | Houle . | |
| 3,256,839 | 6/1966 | Paterson et al. . | |
| 3,464,371 | 9/1969 | Gifford . | |
| 3,477,395 | 11/1969 | Brown et al. . | |
| 3,626,060 | 12/1971 | Blatt | 108/51.3 |
| 3,666,165 | 5/1972 | Osborne et al. . | |
| 3,683,822 | 8/1972 | Roberts et al. . | |
| 3,913,154 | 10/1975 | Sweeney . | |
| 3,927,624 | 12/1975 | Hewson . | |
| 3,940,101 | 2/1976 | Heidelbach . | |
| 4,077,334 | 3/1978 | Svirklys . | |
| 4,359,948 | 11/1982 | Judy et al. . | |
| 4,792,325 | 12/1988 | Schmidtke . | |
| 4,841,879 | 6/1989 | Ferguson . | |
| 4,867,074 | 9/1989 | Quasnick . | |
| 5,001,991 | 3/1991 | Smith | 108/51.3 |
| 5,184,558 | 2/1993 | Wozmacki | 108/51.3 |
| 5,329,861 | 7/1994 | McCarthy | 108/51.3 |

*Primary Examiner*—Jose V. Chen
*Attorney, Agent, or Firm*—Marshall & Melhorn

[57] ABSTRACT

A pallet member is constructed of a longitudinally extending core means surrounded by an outer covering of parametric horizontally and vertically running panels. The longitudinally extending core means may be a plurality of separate rectangular-shaped pieces glued together to form a closely packed, or solid core of adjacent vertically oriented panels. The corrugations of the individual rectangular panels may extend horizontally or vertically or panels having horizontally extending corrugations may be alternated with panels having vertically extending corrugations. Alternately, the core means may be made of a one-piece pleated piece of corrugated fiberboard which is folded accordion-style and glued to form the closely-packed core.

30 Claims, 5 Drawing Sheets

PARAMETRICALLY WRAPPED PALLET MEMBER AND PALLET CONSTRUCTED THEREOF

RELATED APPLICATIONS

This application is a continuation-in-part of U.S. patent application Ser. No. 08/040,338, filed Mar. 30, 1993, now U.S. Pat. No. 5,357,875 which is a continuation of U.S. patent application Ser. No. 07/792,182, filed Nov. 14, 1991 (now U.S. Pat. No. 5,218,913), which is a continuation-in-part of U.S. patent application Ser. No. 07/631,714, filed Dec. 21, 1990 (now abandoned), which is a continuation of U.S. patent application Ser. No. 07/321,022, filed Mar. 9, 1989 (now U.S. Pat. No. 4,979,446). The disclosure of U.S. Letters Patent Nos. 4,979,446 and 5,218,913 and 5,357,875 are specifically incorporated herein by reference.

FIELD OF THE INVENTION

This invention relates in general to a pallet member. More specifically, the present invention relates to a pallet member made of a corrugated material and a pallet constructed thereof. Most specifically, the present application relates to a parametrically wrapped pallet member made of a corrugated material, and a pallet constructed thereof.

DESCRIPTION OF THE PRIOR ART

The pallet members disclosed in said aforementioned U.S. applications were in the form of base and deck members formed of folded corrugated material comprising a solid core of adjacent vertically oriented panels surrounded by an outer covering of parametric horizontally and vertically running panels. The base and deck members were of different cross sections for additional strength, and the parametric wrapping surrounded the core on all sides to provide for maximum strength, and to eliminate any exposed flutes which may be ground contacting.

While said aforementioned pallets are completely satisfactory, and millions are being sold because of their high strength and durability, it has been found that such pallet is over-designed for certain applications, and as such, is not cost-competitive. Modifications have been developed wherein the parametric wrapping can be preserved for strength, and to prevent flute exposure, but at the same time a lighter weight and less expensive construction can be made.

SUMMARY OF THE INVENTION

A pallet member is constructed of a core means wrapped or surrounded by an outer covering of parametric horizontally and vertically running panels covering at least three sides of said core means. The core means is preferably a longitudinally extending core means and may be a plurality of separate rectangular shaped pieces. Alternately, a one piece blank may be creased to have a number of longitudinally extending panels formed therein, and then folded accordion style, or otherwise, to form the solid core.

The corrugations of the individual panels may extend horizontally or vertically. They may have notches prepunched in them, or have notches placed therein after the pallet member is assembled.

In one modification of the present invention, a pallet member is disclosed which has a closely-packed core means formed of a plurality of vertically oriented, longitudinally extending, corrugated fiberboard members which have been glued together to form a solid core, and further which has a plurality of horizontally and vertically running parametric panels surrounding said core means on all four sides.

In another modification of the present invention, the closely-packed core is formed as aforementioned, but the parametric wrapping surrounds the closely-packed core only at its bottom and both side walls, in the form of an upwardly extending U.

In yet another modification of the present invention, the closely-packed core is formed as aforementioned, but the parametric wrapping surrounds the closely-packed core only at its top and bottom and one side wall in the form of a C-shaped parametric wrapping.

In another embodiment of the present invention, the pallet members are notched to form a plurality of interlocking members, some of said pallet members thus forming a first plurality of elongated base members laid longitudinally in parallel spaced apart positions, and some of said pallet members forming a second plurality of elongated deck members laid laterally in parallel spaced positions and intersecting said base members at longitudinally displaced positions therealong to interconnect the same to form a free-standing, lattice-type pallet structure.

It is an object of the present invention to provide a pallet member manufactured of corrugated material which, is parametrically wrapped.

It is a further object of the present invention to provide a pallet constructed of pallet members of the foregoing nature.

A still further object of the present invention is to provide a pallet member which is made of a closely-packed core means surrounded by horizontally and vertically running parametric panels which cover said core means on at least three of four sides.

It is a still further object of the present invention to provide pallet member of the foregoing nature wherein said core means is made of a plurality of vertically oriented, longitudinally extending, panels fastened together to form a solid core of adjacent vertically oriented panels.

It is still a further object to provide a pallet member having a core means formed of a plurality of vertically oriented, longitudinally extending, corrugated blanks having horizontally running flutes.

It is still a further object of the present invention to provide a pallet member having a core means formed of a plurality of vertically oriented, longitudinally extending, corrugated blanks having vertically running flutes.

It is still a further object of the present invention to provide a pallet member having a core means formed of a plurality of vertically oriented, longitudinally extending, corrugated blanks having alternate vertically and horizontally running flutes.

Still a further object of the present invention is to provide a pallet member of the foregoing nature wherein said closely-packed core is formed of a single piece of fiberboard having a plurality of longitudinally extending panels which are folded together accordion-style, or otherwise, to form a closely-packed core.

Further objects and advantages of this invention will be apparent from the following description and appended claims, reference being made to the accompanying drawings forming a part of the specification, wherein like reference characters designate corresponding parts in the several views.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENTS

Figure 1:
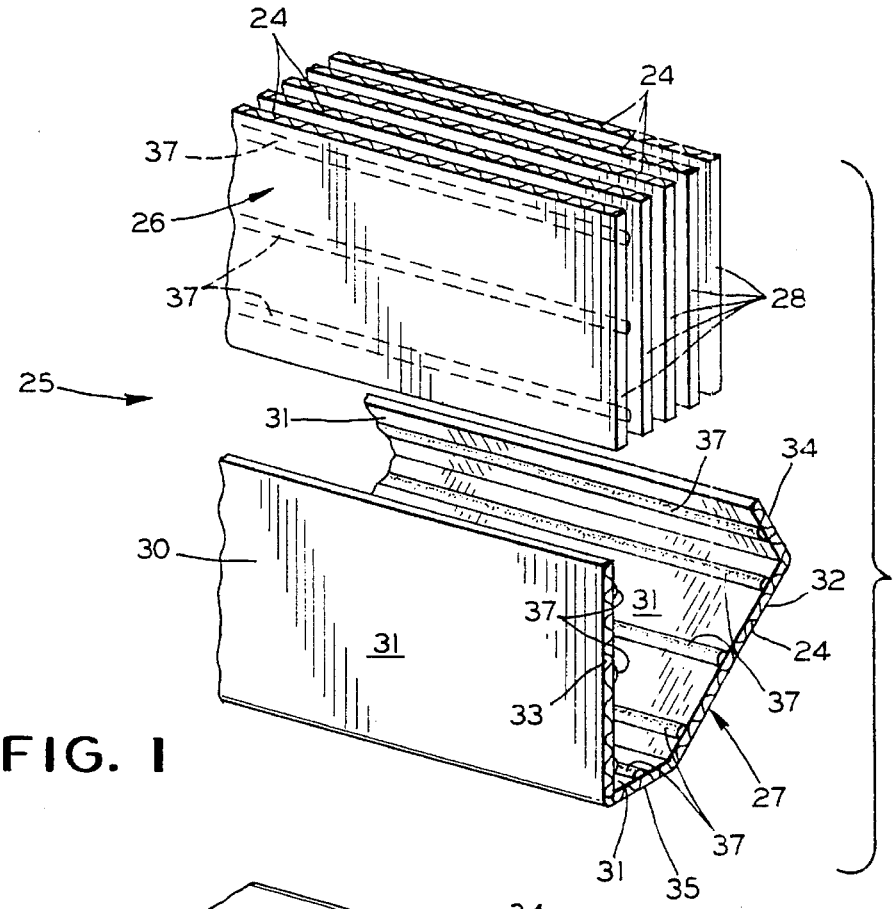
FIG. 1 is an exploded perspective view, partially cut away, of a pallet member embodying the construction of the present invention.
Figure 2:
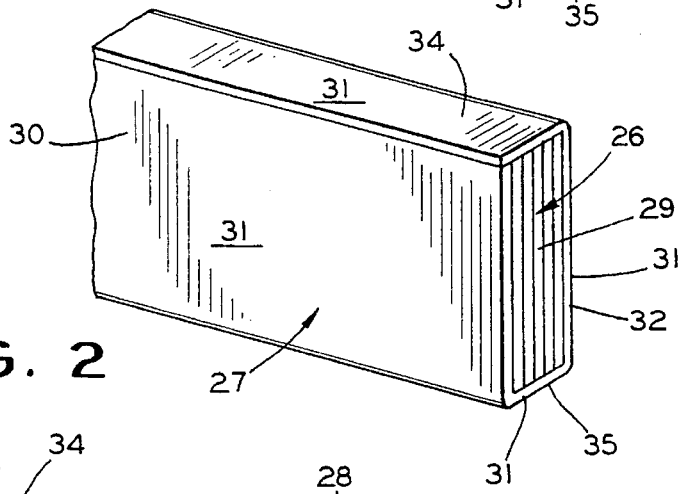
FIG. 2 is a perspective view, partially cut away, showing the pallet member of FIG. 1 in its assembled condition.
Figure 6:
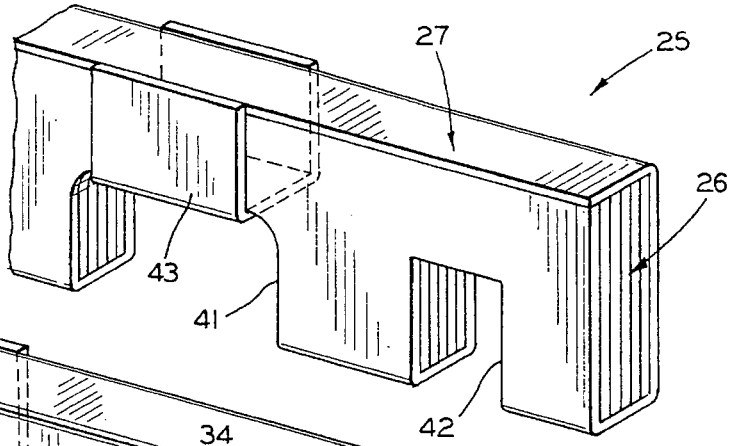
FIG. 6 is a perspective view, partially cut away, of the construction shown in FIG. 2, and further showing a notch and a tine cutout, said tine cutout being wrapped with a U-shaped tine support or reinforcement.

Referring to FIGS. 1, 2 and 6, there is shown a first preferred embodiment of a construction embodying the present invention. There is shown a parametrically wrapped pallet member or beam generally designated by the numeral 25. The pallet member 25 is formed of a core means, generally designated by the numeral 26, which may be formed of various materials as will be more fully described hereinafter; and a wrapping means, generally designated by the numeral 27.

The core means 26 is generally constructed of a plurality of identical longitudinally extending rectangular blanks 28 of corrugated material. In the illustration shown, there are five corrugated blanks 28, although the number may vary depending on the application. The corrugations or flutes 24 in each of the blanks 28 is oriented in the vertical direction for maximum load bearing strength.

Figure 1A:
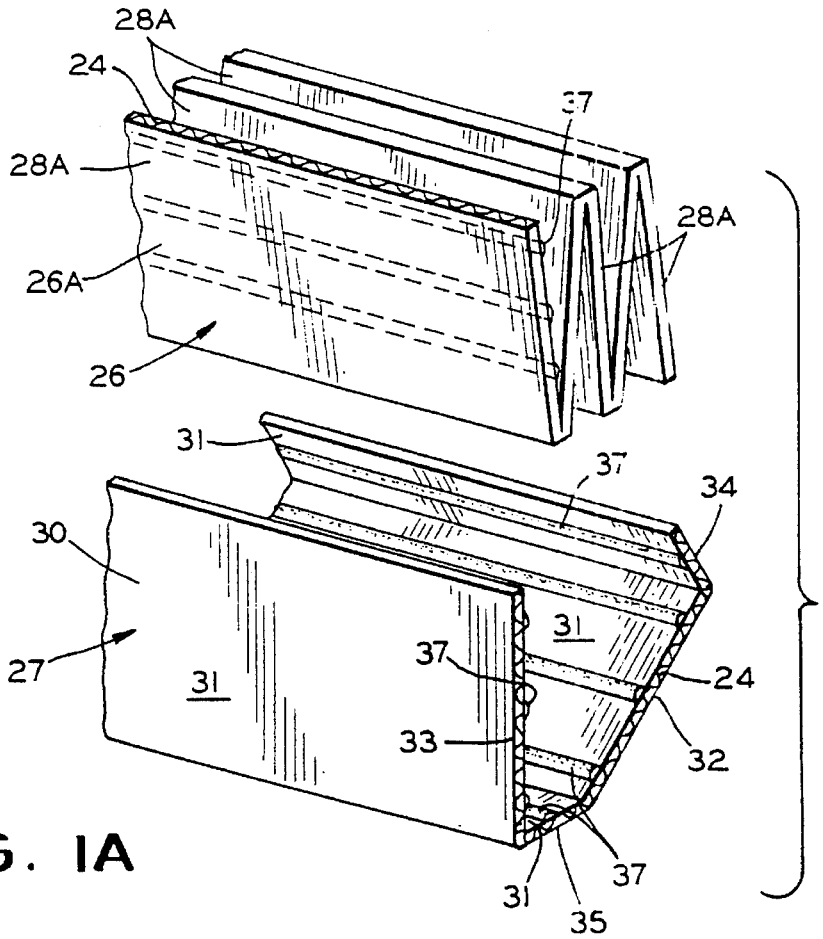
FIG. 1A is an exploded perspective view, similar in large part to FIG. 1, showing a pallet member embodying the construction of the present invention wherein the solid core is formed of a single sheet of material.

Alternately, referring to FIG. 1A, the core means 26 may be formed by the use of a single blank 26A which has been creased to form a series of longitudinal panels 28A which then may be folded together accordion-style or otherwise, to form a core means 26 of adjacent vertically oriented panels 28A surrounded by an outer covering or wrapping means 27 of parametric horizontal and vertically running panels.

It will easily be understood by one skilled in the art that the flutes or corrugations 24 may be placed to run in a vertically extending direction in all of the blanks 28 or that some of the blanks may have vertical flutes 24 while others of the blanks may have horizontal flutes (not shown), or all the flutes may run in a horizontal, longitudinally extending direction. Also, it is not necessary that all of the blanks be made of the same material, or even of corrugated material, depending on the particular application. Also, although a double walled corrugated material is shown, it is not necessary that this be used.

Likewise, the wrapping means 27 may be made of a large variety of materials, and may have its flutes 24 extending in either the horizontal or vertical direction. Since the parametrically wrapped pallet member or beam 25 may be used in various orientations, it should be understood that the terms "horizontal" and "vertical" are being used with reference to the drawings attached to the present application, and may assume various orientations in use. The wrapping means 27 in the embodiment of the invention illustrated in FIGS. 1, 2 and 6 is made from a single blank of fiberboard 30 which has been creased to form four panels 31.

Referring to FIG. 2, which shows the embodiment of FIG. 1 in its assembled condition, two of the panels 31 of the fiberboard or cardboard blank 30 form side walls and more particularly, a first or right hand side wall 32, and a second or left hand side wall 33, of the assembled pallet member 25. Likewise, the other two panels 31 form a top wall 34 and a bottom wall 35.

In the stage of manufacture of the pallet member or beam 25 shown in FIG. 2, a plurality of blanks of a desired material have been cut to form the rectangular blanks 28 shown by means well known in the art.

Depending on the particular application to which the pallet member 25 is to be put, the blanks 28 may be glued, stapled, mechanically connected, chemically bonded, or otherwise fastened together to form the closely-packed core 29 illustrated in FIG. 2. For purposes of illustration, a plurality of glue beads 37 have been shown as being applied to the blanks 28 of FIG. 1. Such glue is preferably a cold glue such as Fuller or Borden's or Henkel. However, hot glue may be used, if desired.

After the closely-packed core is formed, the wrapping means 27 is applied in a desired fashion depending upon the particular application. In the embodiment illustrated, glue is applied to the inside of first or right hand side wall 32 (again for the purposes of illustration beads of glue 37 are shown), second or left hand side wall 33, top wall 34, and bottom wall 35 by means well known in the industry. The blank 30 is then wrapped around the closely-packed core 29 and held in place for a sufficient time for the glue to dry. If other fastening means are being used, the appropriate process is well within the scope of the present invention.

Figure 10:
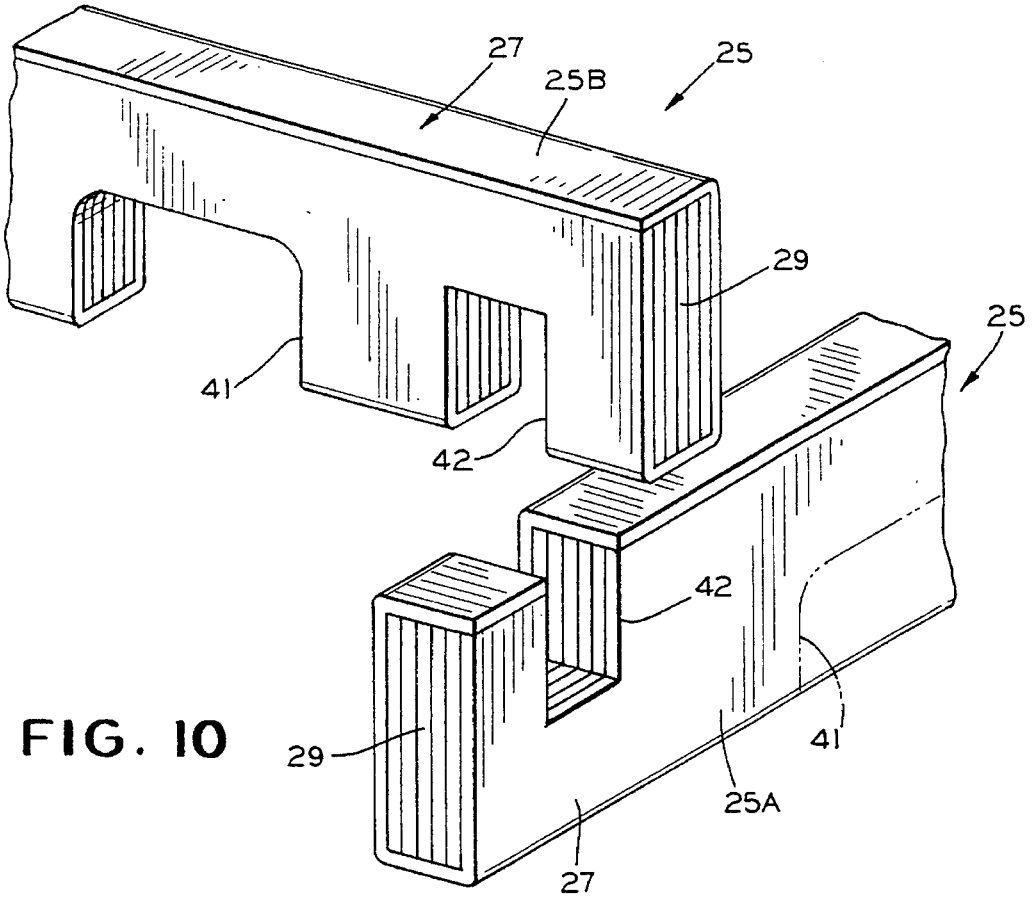
FIG. 10 is a diagrammatic view, showing how the pallet members of FIGS. 6–9 may be assembled to form a free standing lattice or pallet structure.
Figure 11:
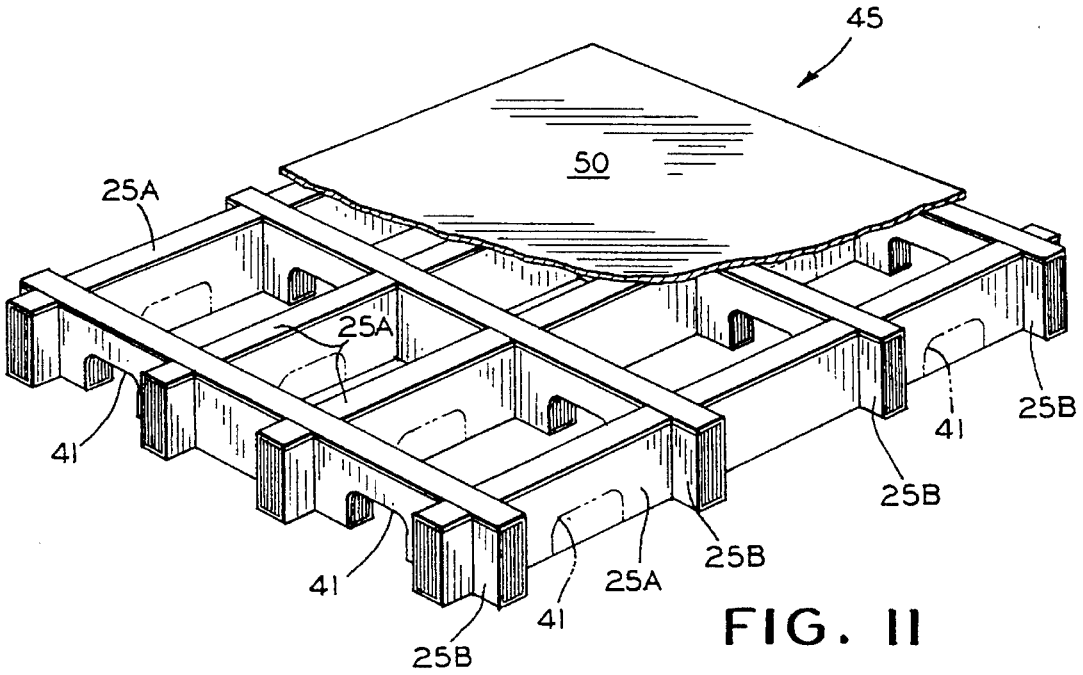
FIG. 11 is perspective view, partially cut away, of a pallet construction formed by interlocking pallet members in the manner shown in FIG. 10.

Referring to FIGS. 6, 10 and 11 it can be seen that generally two types of notches will be provided in the beam member 25. These are a tine cutouts or notch 41 and an assembly notch 42. Generally two tine cutouts 41 and four assembly notches 42 will be provided in each of the pallet members 25. In the example shown in FIG. 11, where only two-way tine access is desired, some of the pallet members 25 may not have tine cutouts 41.

The tine cutouts 41 and assembly notches 42 may be provided in the pallet members 25 by various methods of manufacture. The wrapping means 27 and the blanks 28 may have preformed cutouts so upon assembly the tine cutouts 41 and the assembly notches 42 are automatically formed in the pallet member 25. Alternately, a pallet member 25 may be assembled as shown in FIG. 2, and the tine cutouts 41 and the assembly notches 42 may be placed therein by means well known in the art, such as sawing or water jet cutouts.

The members or beams 25 are interconnected at their points of intersection by locking and linking joints, and application of glue, in which a protuberance or void of one member mates in close tolerance relationship with a complimentary protuberance or void of an intersected member. The joint should impart sufficient rigidity to the intersection to maintain a fixed relationship between them under longitudinally, lateral, and axially rotational forces to be experienced during normal pallet handling.

As shown in FIG. 11, a plurality of the pallet members 25 may be used to assemble a free-standing lattice structure. A first plurality of spaced parallel and longitudinally extending pallet members 25A are interconnected by a plurality of spaced parallel and laterally extending beam members 25B to form a superior, weight supporting free-standing lattice structure. Tine cutouts or notches 41 are provided as desired to give two-way or four-way tine access through the floor contacting beam members 25B.

The only difference between the parallel and longitudinally extending pallet members 25A and the spaced parallel and laterally extending beam members 25B in the illustrated embodiment is that for the parallel and longitudinally extending pallet members 25A the assembly notches 42 are upwardly facing U-shaped rectangular notches having spaced vertical walls ascending from opposite edges of an interior horizontal wall, while in the spaced parallel and laterally extending beam members 25B the assembly notches 42 are downwardly facing U-shaped notches.

The notches 42 are oriented perpendicularly to the elongation of the respective members 25A, 25B with the width of notches 42 preferably but not necessarily being slightly less than the width (dimension perpendicular to the elongation) of the opposing member. To provide the level top and bottom surfaces, the vertical dimensions of the longitudinal members 25A and lateral members 25B are made equal, and the depths of the notches 42 are selected so that the interior horizontal wall of the notch 42 in member 25A is at the same elevation as the top (lifting) surface of the notch 42 in the member 25B, and the sum of the depths of the notches is equal to the vertical dimension of each member 25A, 25B.

The pallet 45 formed thereby may, if desired, have a top sheet 50 attached thereto by gluing or other means well known in the art for additional strength. Where needed, tine supports or reinforcements 43 (FIG. 6) may be provided at the top of the tine cutouts or notches 41. The tine support 43 in the embodiment illustrated is a single sheet corrugated fiberboard material glued, stapled or otherwise connected to the pallet member 25 at the top of the tine cutout or notch 41 by means well known in the art, and generally assumes the shape of an upwardly extending U. Such tine supports or reinforcements 43 may be placed on none, some, or all of the tine cutouts 41 depending on the particular application.

Figure 3:
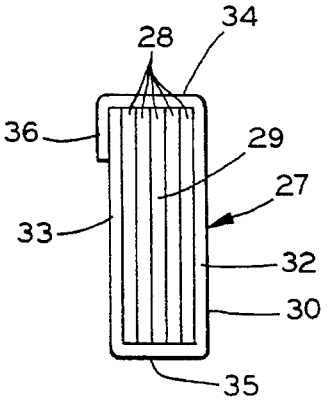
FIG. 3 is an end view of a modification of the construction shown in FIG. 2.
Figure 7:
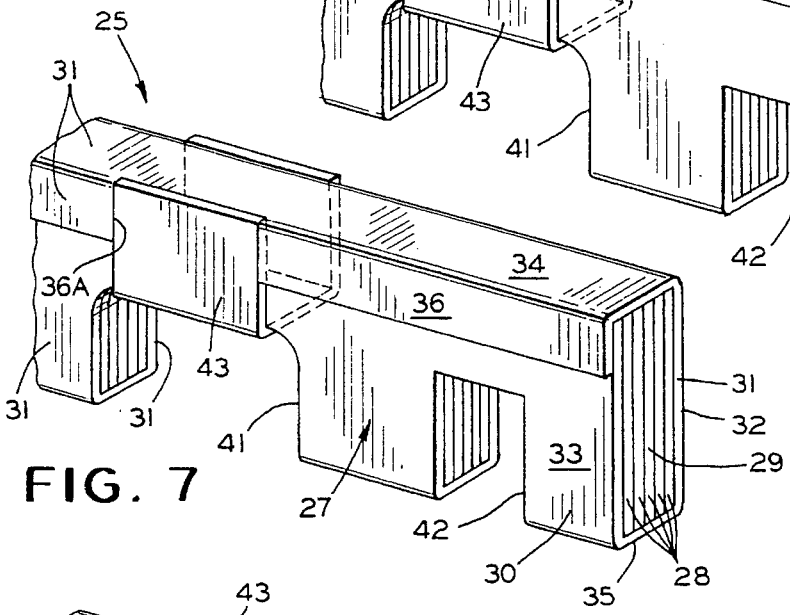
FIG. 7 is a perspective view, partially cut away, of the construction shown in FIG. 3, also showing the notch or tine cutout and tine support or reinforcement, similar to that shown in FIG. 6.

Another embodiment of the present invention is shown in FIGS. 3 and 7. FIG. 3 is in large part similar to FIG. 2 in that the closely-packed core 29 is made of individual blanks 28 fastened together in the manner previously described. The core 29 is surrounded by a wrapping means 27 formed of a fiberboard blank 30 suitably creased to form a plurality of longitudinally extending panels 31. In this embodiment, in addition to forming the first or right hand side wall 32, the second or left hand side wall 33, the top wall 34 and the bottom wall 35, an additional overlapping panel 36 is formed. In some applications depending on the direction of the flutes 24 (not shown), it is difficult to glue the panels 31 to the top and bottom of the core 29. In this instance, the overlapping panel 36 can be glued to the second or right hand side wall 32 to provide for gluing the wrapping means 27 back upon itself, and to add additional strength. The remainder of the construction of FIG. 3 in the embodiment illustrated is identical to that shown in FIG. 2, except that a cutout 36A, in the overlapping panel 36 is necessary to provide for the placement of the tine support 43.

Figure 7A:
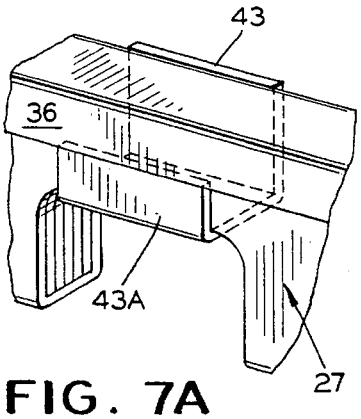
FIG. 7A is a modification of the construction shown in FIG. 7.

Alternately, as shown in FIG. 7A, one leg 43A of the tine support 43 may be made shorter and abut up against the overlapping panel 36A of the wrapping means 27.

Figure 4:
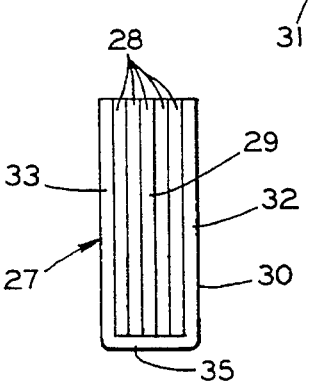
FIG. 4 is an end view of a further modification of the construction shown in FIG. 2.

Likewise, the embodiment shown in FIG. 4 is similar in large part to the construction illustrated in FIGS. 1 and 2. The only difference is that the wrapping means 27 only surrounds (covers) the closely-packed core 29 on three sides. This embodiment has been found preferable where exposure to wet operating conditions is not expected, and maximum loads will not be encountered. Since this embodiment uses less cardboard and is wrapped only on three sides, it is also less expensive to manufacture.

More specifically, the closely-packed core 29 is surrounded by a fiberboard blank 30 which is creased to form a first or right hand side wall 32, a second or left hand side wall 33 and a bottom wall 35. The blank 30 thus creased forms the wrapping means 27 which is applied to the closely-packed core 29 in the form of an upwardly extending U.

Figure 8:
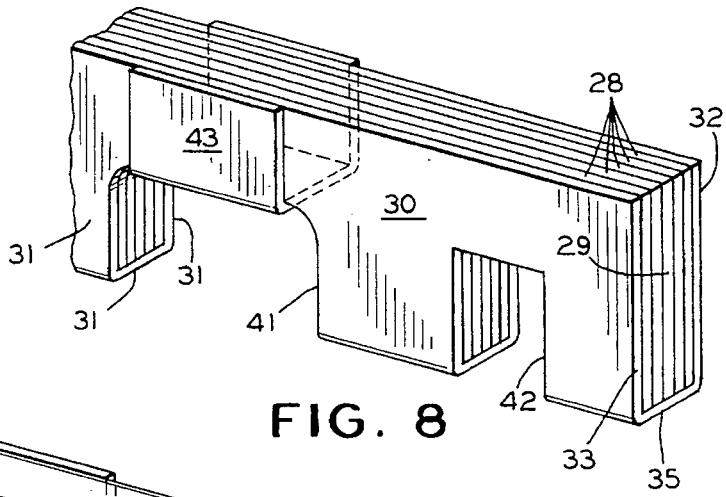
FIG. 8 is a perspective view, partially cut away, of the construction shown in FIG. 4, also showing the notch or tine cutout and tine support or reinforcement, similar to that shown in FIG. 6.

A pallet member 25 formed by using the construction of FIG. 4 is shown in FIG. 8. The pallet member, except for the differences described, is identical in construction to that more fully described in FIG. 6, and no additional description is believed needed.

Figure 5:
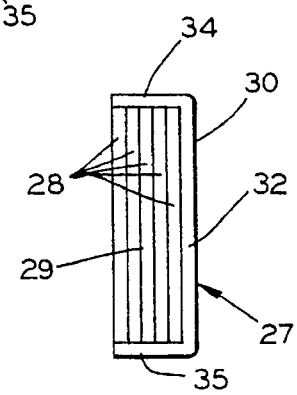
FIG. 5 is an end view of a still further modification of the construction shown in FIG. 2.

Another modification of the beam member 25 is shown in FIG. 5. This modification is in large part similar to the modification just described relation to FIG. 4, except the wrapping means 27 formed of blank 30 has been creased to form a top wall 34, a bottom wall 35 and a first or right hand side wall 32. The wrapping means 27 is applied to the closely-packed core 29 in a manner to form a C-shaped wrapping means 27.

Figure 9:
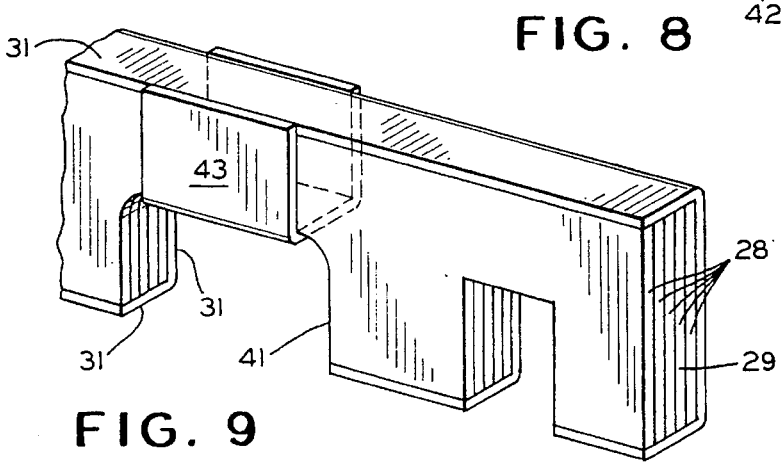
FIG. 9 is a perspective view, partially cut away, of the modification shown in FIG. 5, and also showing the notch or tine cutout and tine support or reinforcement, similar to that shown in FIG. 6.

A perspective view of the pallet member 25 illustrated in FIG. 5 is shown in FIG. 9. Again, the pallet member 25 may have formed therein tine cutouts 41 and assembly notches 42. A tine support or reinforcement 43 may be applied as previously described, if desired.

The pallet shown in FIG. 11 can be manufactured using beam members 25 constructed in accordance with any of the modifications described in connection with FIGS. 1 through 9. Due to the unique design of the longitudinally extending pallet members, a pallet in accordance with the invention can support a load in excess of conventional corrugated pallets. The design of the pallet provides for more load supporting members to contact either the floor or the top of an underlying pallet load. This insures greater weight distribution and, for stacked pallets, significantly reduces crushing or creasing of load (in most instances boxes) of underlying pallets. Because the base and deck members support the load through contact with the floor in both the longitudinal and lateral direction, the pallet in accordance with the invention can traverse most roller conveyor systems in any direction. Prior art pallets which have only longitudinal floor support are limited to movement in only one direction since the rollers must generally be oriented perpendicularly to the main supporting member in order to roll the pallet. The pallet design provides for the ability of the pallet to absorb and withstand motion shock in all directions. By providing for interlocking members and having all supporting members contacting the floor, this pallet will not collapse because of any side motion pressure. Prior art pallets do not have this ability and are thus subject to failure when used to transfer loads by truck or rail over long distances.

The four-way entry version provides four-way entry while maintaining superior strength and break resistance not available in similar prior art construction. Different size and strength requirements of users can be met without the need to vary the overall design. Changes in dimensions, weight and type of corrugated or other material utilized will not interfere with the basic performance characteristics. This is not the case for prior art units.

Figure 12:
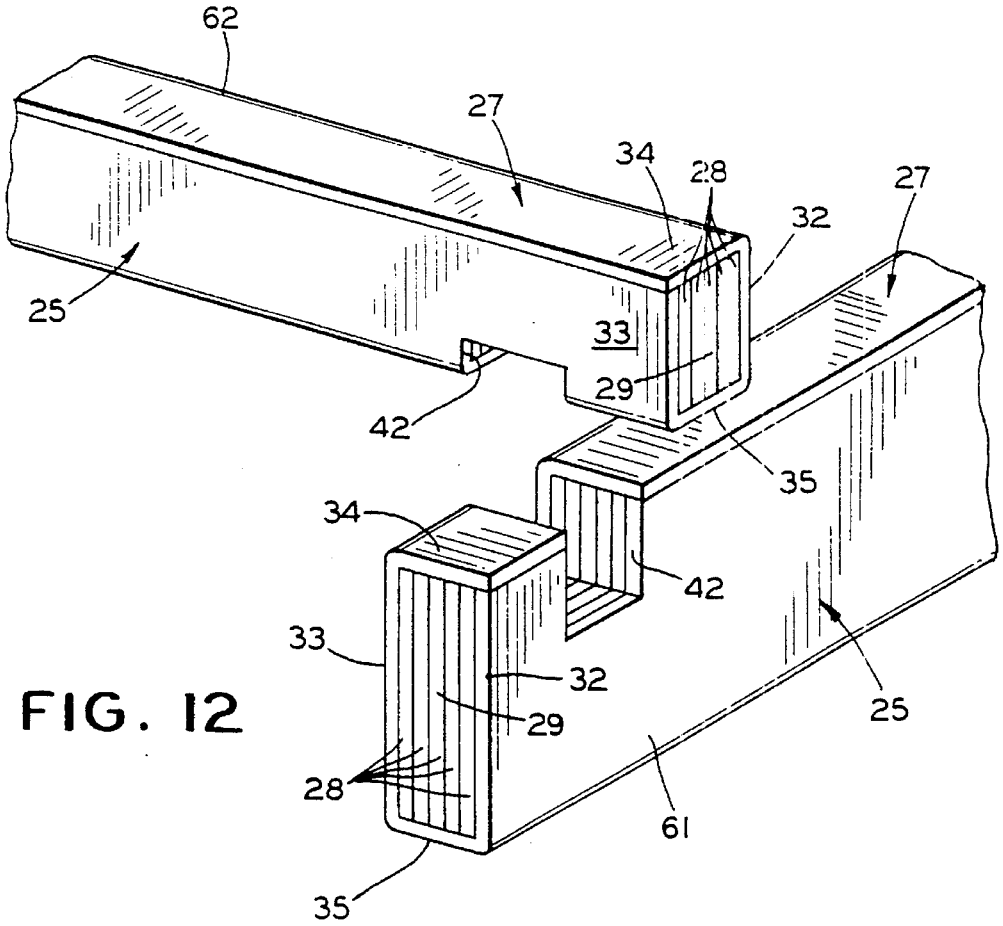
FIG. 12 is a modification of the construction shown in FIG. 10.
Figure 13:
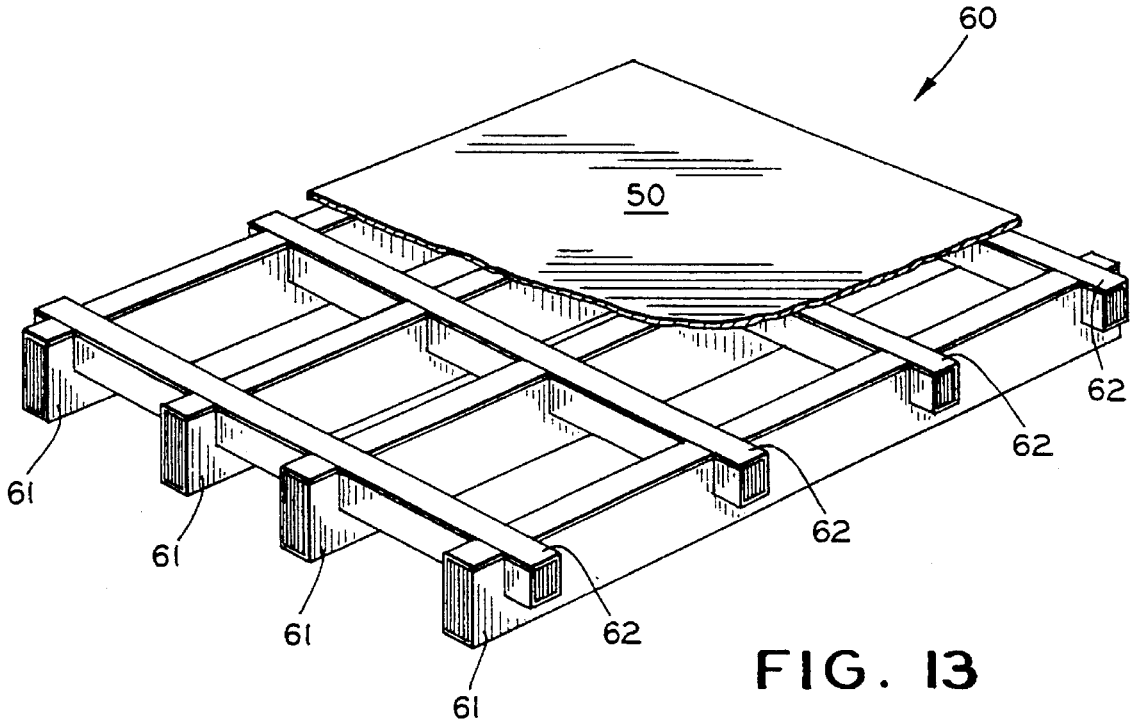
FIG. 13 is a perspective view, partially cut away, showing how a pallet may be formed from the pallet members shown in FIG. 12.

A further modified form of the invention is shown in FIGS. 12 and 13. Pallet 60 is formed of base members 61 which may be similar to the parametrically wrapped pallet members or beams 25 described in connection with any one of FIGS. 1 through 10. The deck members 62 also may be similar in construction to any one of the parametrically wrapped pallet members or beams 25 described in connection with FIGS. 1 through 10, but are simply of smaller cross-section.

Since the cross-sectional area of the deck member 62 is less than that of the base member 61, the assembly notch 42 in the deck member 62 may be of smaller dimension than the assembly notch 42 in the base member 61 and still have the top surface of the deck member 62 coplanar or flush with the top surface of the base member 61. However, it is obvious that the lower surface of the deck member 62 is no longer coplanar with the lower surface of the base member 61.

Figure 14:
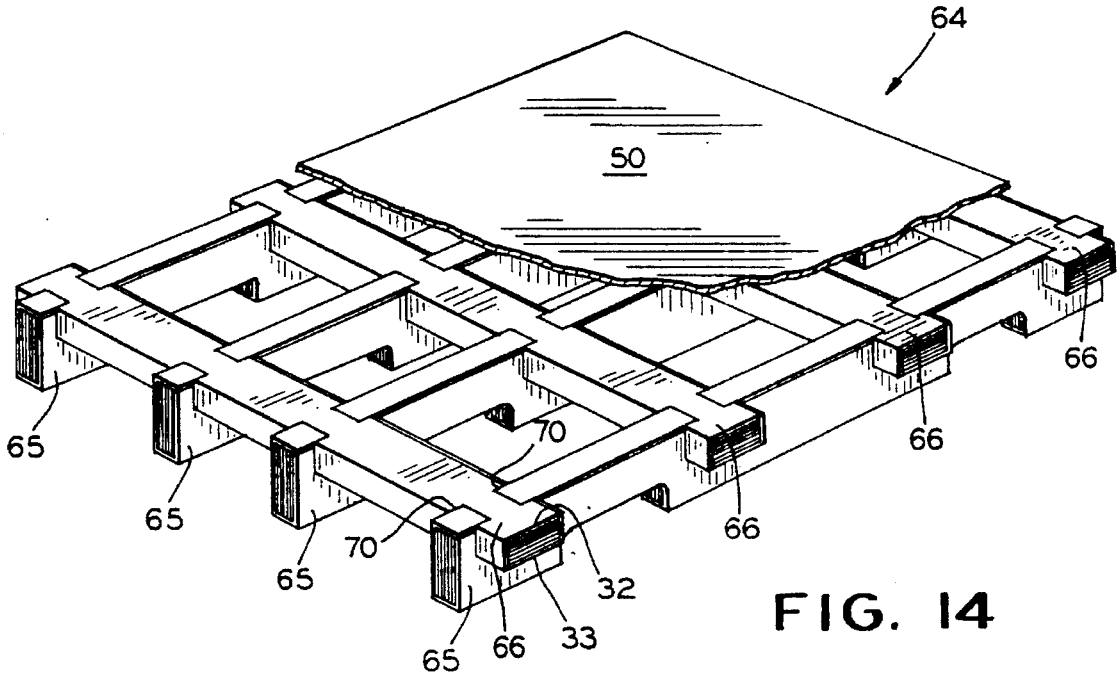
FIG. 14 is a modification of the construction shown in FIG. 11.

A further modification of the invention is shown in FIG. 14 as pallet 64. In this case the construction of the base member 65 and the deck member 66 may be similar to any of the embodiments illustrated in connection with FIGS. 1 through 9. The assembly notch 42 in the deck member 65 is similar to the embodiments just described, but the assembly notches 70 in the deck member 66 are now in the form of a pair of opposed U-shaped notches extending between the side walls 32 and 33 of the deck member 66. As before, a top sheet 50 can be added, if desired.

By careful and continuing consideration of everyday problems experienced in the corrugated pallet art, a novel and useful modification of pallets disclosed in the aforementioned co-pending applications have been provided.

What is claimed is:

1. A parametrically wrapped separate and distinct pallet member consisting of:

(a) a closely packed core of adjacent vertically oriented panels and (b) a wrapping means consisting of four panels of parametric, horizontal and vertically running panels surrounding said closely-packed core on all four sides.

2. A parametrically wrapped separate and distinct pallet member consisting of:

(a) a closely packed core of adjacent vertically oriented panels, and (b) a wrapping means of parametric, horizontal and vertically running panels surrounding said closely-packed core on a first side, a second side, and its bottom substantially along the entire length of said member.

3. A parametrically wrapped separate and distinct pallet member consisting of:

(a) a closely packed core of adjacent vertically oriented panels, (b) a wrapping means of parametric, horizontal and vertically running panels surrounding said closely-packed core on its top, its bottom and one side substantially along the entire length of said member.

4. A parametrically wrapped pallet member consisting of:

(a) a closely packed core of adjacent vertically oriented panels, and (b) a five panel wrapping means of parametric, horizontal and vertically running panels surrounding said core on all four sides and having an overlapping panel fastening said wrapping means back upon itself;

said pallet member having a protuberance or void for mating with a complementary protuberance or void in another pallet member.

5. A pallet of corrugated material for the shipment and storage of a load of goods stacked therein, comprising:

(a) a plurality of elongated base members laid longitudinally in parallel, spaced positions; and (b) a plurality of elongated deck members laid laterally in parallel, spaced positions and intersecting said base members at longitudinally, displaced positions thereon to interconnect the same to form a free-standing lattice structure; said base and deck members each having top surfaces located in a common upper horizontal plane to provide the level upper platform, and bottom surfaces located in a common lower horizontal plane to provide a stable, floor contacting base;

wherein each of said base and deck members is a parametrically wrapped pallet member consisting of a closely-packed core of adjacent vertically oriented panels surrounded by a wrapping means of parametric, horizontally and vertically running panels surrounding said closely-packed core on all four sides.

6. The pallet defined in claim 5 and including a top sheet attached to said pallet.

7. The pallet defined in claim 5, wherein each of said elongated base members includes a plurality of upwardly facing U-shaped rectangular notches, and each of said deck members include a plurality of opposite horizontally outward facing U-shaped notches for engagement with said upwardly facing U-shaped rectangular notches when said deck members are placed horizontally, the upwardly facing U-shaped rectangular notches of said base members being in a mating engagement with said plurality of opposite horizontally outwardly facing U-shaped notches to form a weight supporting lattice structure wherein said base members and said deck members form a common upper horizontal plane to provide a level upper platform, the bottom surfaces of the horizontally oriented deck members no longer forming a common lower horizontal plane with the bottom surfaces of the base members.

8. The pallet defined in claim 5, wherein a protuberance or void in each base member mates in close tolerance relationship with a complimentary protuberance or void in each deck member, and the bottom surfaces of said base members and said deck members are no longer in a common horizontal lower plane.

9. The pallet defined in claim in 8, and including a top sheet attached to said pallet.

10. A pallet of corrugated material for the shipment and storage of a load of goods stacked therein, comprising:

(a) a plurality of elongated base members laid longitudinally in parallel, spaced positions; and (b) a plurality of elongated deck members laid laterally in parallel, spaced positions and intersecting said base members at longitudinally, displaced positions thereon to interconnect the same to form a free-standing lattice structure; said base and deck members each having top surfaces located in a common upper horizontal plane to provide the level upper platform, and bottom surfaces located in a common lower horizontal plane to provide a stable, floor contacting base;

wherein each of said base and deck members is a parametrically wrapped pallet member consisting of a closely-packed core of adjacent vertically oriented panels surrounded by a wrapping means of parametric, horizontally and vertically running panels surrounding said closely-packed core on a first side, a second side, and its bottom substantially along the entire length of said member.

11. The pallet defined in claim 10 and including a top sheet attached to said pallet.

12. The pallet defined in claim 10, wherein each of said elongated base members includes a plurality of upwardly facing U-shaped rectangular notches, and each of said deck members include a plurality of opposite horizontally outward facing U-shaped notches for engagement with said upwardly facing U-shaped rectangular notches when said deck members are placed horizontally, the upwardly facing U-shaped rectangular notches of said base members being in a mating engagement with said plurality of opposite horizontally outwardly facing U-shaped notches to form a weight supporting lattice structure wherein said base members and said deck members form a common upper horizontal plane to provide a level upper platform, the bottom surfaces of the horizontally oriented deck members no longer forming a common lower horizontal plane with the bottom surfaces of the base members.

13. The pallet defined in claim 10, wherein a protuberance or void in each of said base members mates in close tolerance relationship with a complimentary protuberance or void in each of said deck members, the bottom surfaces of the base members and deck members no longer in a common, lower, horizontal plane.

14. The pallet defined in claim 13 and including a top sheet attached to said pallet.

15. A pallet of corrugated material for the shipment and storage of a load of goods stacked therein, comprising:

(a) a plurality of elongated base members laid longitudinally in parallel, spaced positions; and (b) a plurality of elongated deck members laid laterally in parallel, spaced positions and intersecting said base members at longitudinally, displaced positions thereon to interconnect the same to form a free-standing lattice structure; said base and deck members each having top surfaces located in a common upper horizontal plane to provide the level upper platform, and bottom surfaces located in a common lower horizontal plane to provide a stable, floor contacting base;

wherein each of said base and said deck members is a parametrically wrapped pallet member consisting of a closely-packed core of adjacent vertically oriented panels and surrounded by a wrapping means of parametric, horizontal and vertically running panels surrounding said closely-packed core on its top, on its bottom and one side substantially along the entire length of said member.

16. The pallet defined in claim 15 and including a top sheet attached to said pallet.

17. The pallet defined in claim 15, wherein each of said elongated base members includes a plurality of upwardly facing U-shaped rectangular notches, and each of said deck members include a plurality of opposite horizontally outward facing U-shaped notches for engagement with said upwardly facing U-shaped rectangular notches when said deck members are placed horizontally, the upwardly facing U-shaped rectangular notches of said base members being in a mating engagement with said plurality of opposite horizontally outwardly facing U-shaped notches to form a weight supporting lattice structure wherein said base members and said deck members form a common upper horizontal plane to provide a levels upper platform, the bottom surfaces of the horizontally oriented deck members no longer forming a common lower horizontal plane with the bottom surfaces of the base members.

18. A pallet of corrugated material for the shipment and storage of a load of goods stacked therein, comprising:

(a) a plurality of elongated base members laid longitudinally in parallel, spaced positions; and (b) a plurality of elongated deck members laid laterally in parallel, spaced positions and intersecting said base members at longitudinally, displaced positions thereon to interconnect the same to form a free-standing lattice structure; said base and deck members each having top surfaces located in a common upper horizontal plane to provide the level upper platform, and bottom surfaces located in a common lower horizontal plane to provide a stable, floor contacting base;

wherein each of said base and said deck members is a parametrically wrapped pallet member consisting of a closely-packed core of adjacent vertically oriented panels surrounded by a five panel wrapping means of parametric, horizontal and vertically running panels surrounding said core on all four sides and having an overlapping panel fastening said wrapping means back upon itself said pallet member having a protuberance or void for mating with a complementary protuberance or void in another pallet member.

19. The pallet defined in claim 18 and including a top sheet attached to said pallet.

20. The pallet defined in claim 18 wherein a protuberance or void in each base member mates in close tolerance relationship with a complimentary or protuberance or void in each of said deck members, the bottom surfaces of the base members and deck members no longer in a common lower horizontal plane.

21. The pallet defined in claim 20, and including a top sheet attached to said pallet.

22. The pallet defined in claim 18, wherein each of said elongated base members includes a plurality of upwardly facing U-shaped rectangular notches, and each of said deck members include a plurality of opposite horizontally outward facing U-shaped notches for engagement with said upwardly facing U-shaped rectangular notches when said deck members are placed horizontally, the upwardly facing U-shaped rectangular notches of said base members being in a mating engagement with said plurality of opposite horizontally outwardly facing U-shaped notches to form a weight supporting lattice structure wherein said base members and said deck members form a common upper horizontal plane to provide a level upper platform, the bottom surfaces of the horizontally oriented deck members no longer forming a common lower horizontal plane with the bottom surfaces of the base members.

23. A pallet of corrugated material for the shipment and storage of a load of goods stacked thereon comprising:

(a) a plurality of elongated base members laid longitudinally in parallel, spaced positions; and (b) a plurality of elongated deck members laid laterally in parallel, spaced, positions and intersecting said base members at longitudinally displaced positions thereon to interconnect the same to form a free-standing lattice structure; said base and deck members each having top surfaces located in a common upper horizontal plane to provide the level upper platform, wherein each one of said base and deck members comprises a solid core of adjacent panels surrounded by an outer covering of parametric, horizontal and vertically running panels extending substantially along the entire length of said members.

24. The pallet defined in claim 23, wherein said deck members are square cross-sectioned runners, and the bottom surfaces of said deck members and said base members are not in a common lower horizontal plane.

25. The pallet defined in claim 23, wherein each of said elongated base members includes a plurality of upwardly facing U-shaped rectangular notches, and each of said deck members includes a plurality of opposite, horizontally outward facing, U-shaped notches for engagement with said upwardly facing U-shaped rectangular notches, the upwardly facing U-shaped rectangular notches of said base members being in mating engagement with said plurality of opposite horizontally outward facing U-shaped notches to form a weight supporting lattice structure, wherein said base members and said deck members form a common upper horizontal plane to provide a level upper platform, and the bottom surfaces of the base members and deck members are not in a common lower horizontal plane.

26. The pallet defined in claim 23, wherein a protuberance or void in at least one of said base members mates in close tolerance relationship with a complimentary protuberance or void in at least one of said elongated deck member.

27. The pallet defined in claim 26, and including a top sheet attached to said pallet.

28. A pallet of corrugated material for the shipment and storage of a load of goods stacked thereon, and the like comprising:

(a) a plurality of spaced, parallel and longitudinally extending base members;

(b) a plurality of spaced, parallel and laterally extending deck members; wherein each base member is a rectangular cross-sectioned member having a planer top surface and comprising a first closely packed core of adjacent vertically stacked panels; and wherein each deck member is a rectangular cross-section member having a planer top surface and comprising a second closely packed core of adjacent horizontally stacked panels; each base member being further provided with a plurality of longitudinally spaced parallel and laterally extending first U-shaped notches which open upwardly onto each said base member top surface; each deck member having opposing vertical sides and being further provided with a plurality of laterally spaced parallel and vertically extending opposing pairs of second U-shaped notches, one notch of each pair opening to one vertical side and the other notch of each pair opening to the other vertical side; said deck members being respectively inserted at said pairs of second notches into corresponding ones of said first notches to establish the longitudinal spacing of said deck members, said first notches being longitudinally dimensioned less than spacings between ones of said pairs of said second notches by an amount sufficient to apply an interference force fit for interconnecting said base members to said deck members to establish the lateral spacing of said base members; and said first notches being vertically dimensioned relatively the same as corresponding vertical dimensions between said ones of said pairs of first notches of said deck members so that said deck members inserted into said first notches presents said deck member top surfaces in a common plane with said base member top surfaces.

29. A pallet of corrugated material for the shipment and storage of a load of goods stacked thereon, comprising:

(a) a plurality of elongated base members laid longitudinally in parallel, spaced positions; and (b) a plurality of elongated deck members laid longitudinally in parallel, spaced, positions and intersecting said base members at longitudinally displaced positions therealong to interconnect the same to form a free-standing lattice structure;

said base and deck members each having top surfaces located in a common upper horizontal plane to provide a level upper platform, and bottom surfaces located in a common lower horizontal plane to provide a stable, floor contacting base; wherein each of said base and said deck members is a pallet member consisting of a closely packed core of adjacent vertically oriented panels connected together by locking and linking joints wherein each of said elongated base members includes a plurality of upwardly facing U-shaped rectangular notches, and each of said deck members include a plurality of opposite, horizontally outwardly facing U-shaped notches for engagement with said upwardly facing U-shaped rectangular notches when said deck members are placed horizontally, the upwardly facing U-shaped rectangular notches of said base members being in a mating engagement with said plurality of opposite horizontally outwardly facing U-shaped notches to form a weight supporting lattice structure wherein said base members and said deck members form a common upper horizontal plane to provide a level upper platform, the bottom surfaces of the horizontally oriented deck members no longer forming a common lower horizontal plane with the bottom surfaces of the base members.

30. A pallet of corrugated material for the shipment and storage of a load of goods stacked thereon comprising:

(a) a plurality of elongated base members laid longitudinally in parallel, spaced positions; and (b) a plurality of elongated deck members laid laterally in parallel, spaced, positions and intersecting said base members at longitudinally displaced position thereon to interconnect the same to form a free-standing lattice structure; said base and deck members each having top surfaces located in a common upper horizontal plane to provide the level upper platform, wherein each one of said base and deck members comprises a solid core of adjacent panel surrounded by an outer covering consisting of four parametric, horizontal and vertically running panels.

* * * * *